US008307577B2

(12) United States Patent
Baxter

(10) Patent No.: US 8,307,577 B2
(45) Date of Patent: Nov. 13, 2012

(54) MULTI-FUNCTIONAL PROTECTIVE WEAPON COVER

(76) Inventor: Timothy Baxter, Garner, IA (US)

( * ) Notice: Subject to any disclaimer, the term of this patent is extended or adjusted under 35 U.S.C. 154(b) by 78 days.

(21) Appl. No.: 12/961,577

(22) Filed: Dec. 7, 2010

(65) Prior Publication Data

US 2012/0137566 A1 Jun. 7, 2012

(51) Int. Cl.
*F41A 35/02* (2006.01)

(52) U.S. Cl. ..... 42/96; 224/243; 206/317

(58) Field of Classification Search ..... 42/96; 224/243; 206/317

See application file for complete search history.

(56) References Cited

U.S. PATENT DOCUMENTS

| | | | | |
|---|---|---|---|---|
| 1,560,322 | A * | 11/1925 | Roberts | 42/143 |
| 2,364,340 | A * | 12/1944 | Bogg, Jr. | 42/106 |
| 2,599,689 | A * | 6/1952 | Brelsford | 42/96 |
| 2,758,762 | A * | 8/1956 | Medley | 224/243 |
| 2,932,334 | A * | 4/1960 | Steen | 206/317 |
| 3,701,371 | A | 10/1972 | Stackhouse | |
| 4,433,500 | A | 2/1984 | Kunevicius | |
| 4,530,178 | A * | 7/1985 | Rauscher | 43/26 |
| 4,644,987 | A | 2/1987 | Kiang | |
| 4,754,498 | A | 7/1988 | Stinemates | |
| 4,756,456 | A | 7/1988 | Schauer | |
| RE32,752 | E | 9/1988 | Kiang | |
| 4,858,361 | A | 8/1989 | White | |
| 4,860,479 | A | 8/1989 | Easter | |
| 5,048,217 | A | 9/1991 | Easter | |
| 5,678,344 | A | 10/1997 | Jones et al. | |
| 5,778,590 | A | 7/1998 | Browning et al. | |
| 6,256,922 | B1 | 7/2001 | Jones et al. | |
| 6,626,339 | B2 | 9/2003 | Gates et al. | |
| 7,104,000 | B2 | 9/2006 | Orth | |
| 7,117,625 | B2 * | 10/2006 | Pikielny | 42/90 |
| 7,185,607 | B1 | 3/2007 | Pearson | |
| 7,360,648 | B1 | 4/2008 | Blaschke | |

* cited by examiner

*Primary Examiner* — Michael David

(74) *Attorney, Agent, or Firm* — Zarley Law Firm, P.L.C.

(57) ABSTRACT

A cover for a weapon. The cover comprises a cover body having an open first end and an open second end. The open second end fits around a front end of the weapon's body where a barrel slides into the body of the weapon and the open first end fits around a back end of the weapon leaving the barrel exposed. A top surface of the cover body includes a top opening and an upper flap affixed to the cover body covering the top opening. The cover body also has a first and second lateral side and a belt feed opening on one of the lateral sides of the cover body.

1 Claim, 3 Drawing Sheets

MULTI-FUNCTIONAL PROTECTIVE WEAPON COVER

BACKGROUND OF THE INVENTION

This invention relates to a multi-functional protective cover for a weapon. More specifically, this invention is directed to a heat-resistant covering for a weapon system that that protects and covers the weapon from environmental debris.

In military training and combat operations, air cooled, belt-fed, and gas operated weapons systems including but not limited to the M2 Browning .50 caliber machine gun, the M249 light machine gun (LMG), and the M240-B/M240-S machine gun are extensively used by infantry, armor, combat engineer, special forces/rangers, and selected field artillery units. These weapons and are not only highly adaptable but also provide a tactical advantage on the battlefield supporting soldiers in both offensive and defensive operations. Given their widespread use and effectiveness, these weapon systems are often utilized in training and combat operations under harsh environmental conditions which can lead to the weapon malfunction and accordingly compromise the advantages they present to soldiers.

Although weapons such as the M2, the M249, and the M240-B/M240-S have been designed to function reliably to an extent, because these weapons are characterized by a relatively high degree of mechanical complexity in order to operate properly and produce a high rate of fire, these weapons are susceptible to jamming, malfunctioning, and the like when exposed to debris, particulate matter, and moisture in the air, especially for prolonged periods of time. Furthermore, these weapons are particularly susceptible to malfunction in dry, dusty, and/or sandy environments, as particles of dust, sand and the like can readily be introduced into and accumulate within interior mechanical components of these weapons by the wind or as drawn into the weapon via the belt-fed shells. Furthermore, given the often unpredictable circumstances attendant to their use, these weapons must often be exposed and readily positioned to engage an enemy at virtually all times, and thus the utilization of a traditional tarp or cover for storing the weapon in an unexposed area until needed represent unacceptable options. Therefore, a need exists to provide a multi-functional weapon cover that overcomes these problems.

Therefore, a principal object of the invention is to provide a multi-functional weapon cover that protects a weapon in a variety of harsh environments.

It is yet another object of this invention to provide a multi-functional weapon cover that is heat resistant and waterproof.

A further object of this invention is to provide a multi-functional weapon cover that can be applied quickly and easily.

It is yet another object of this invention is to provide a multi-functional weapon cover that maintains a proper, secure engagement to the weapon while the weapon is reloaded, charged, and fired.

These and other objects, features or advantages of the present invention will become apparent from the specification and claims.

BRIEF SUMMARY OF THE INVENTION

A cover for a weapon comprises a cover body having an open first end and an open second end. The open first end fits around a back end of the weapon's body where a barrel slides into the body of the weapon and the open second end fits around a front end of the weapon leaving the barrel exposed. A top surface of the cover body includes a top opening and an upper flap affixed to the cover body covering the top opening. The cover body also has a first and second lateral side and a belt feed opening on one of the lateral sides of the cover body.

DETAILED DESCRIPTION OF THE PREFERRED EMBODIMENT

Figure 1:
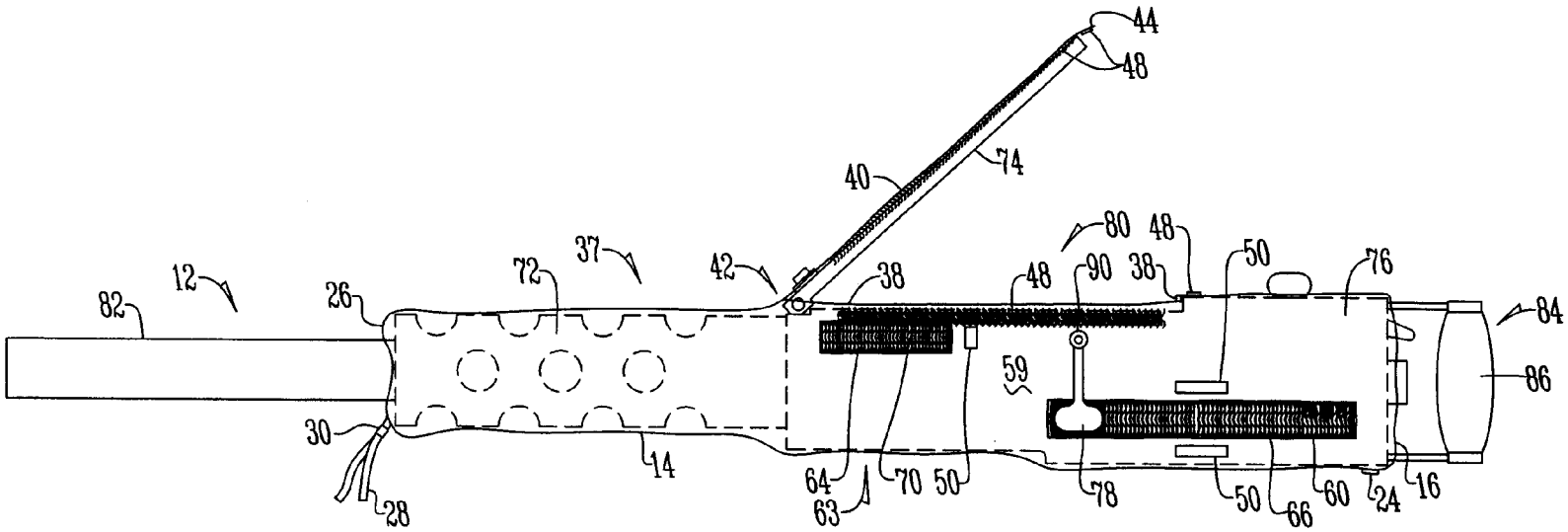
FIG. 1 is a side perspective view of the weapon cover of the present invention mounted on a weapon with the weapon's cover and feed mechanism assembly open.
Figure 2:
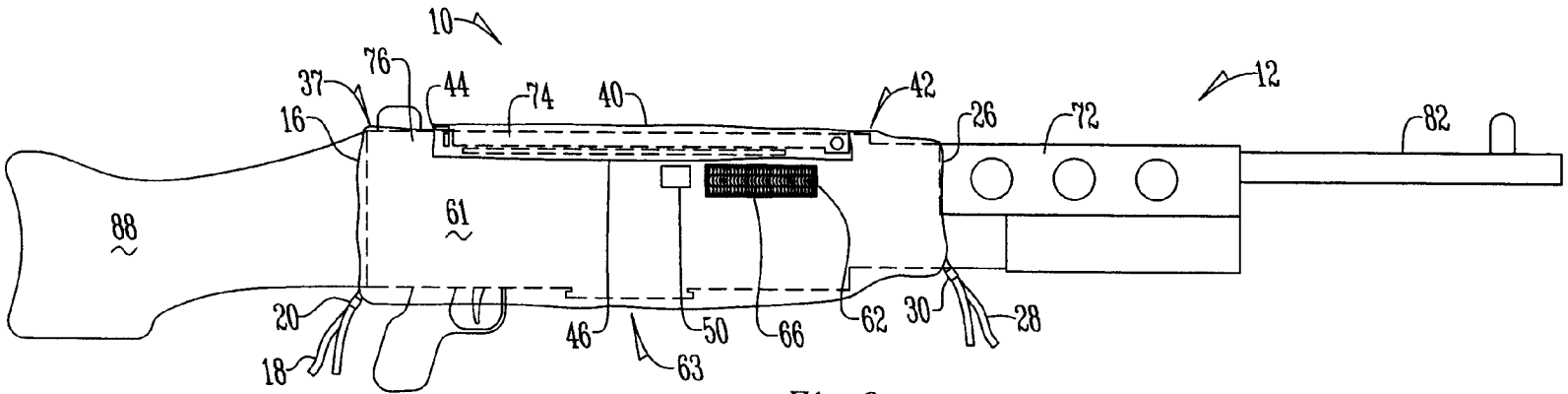
FIG. 2 is a side perspective view of an alternate embodiment of the weapon cover of the present invention mounted on a weapon.
Figure 3:
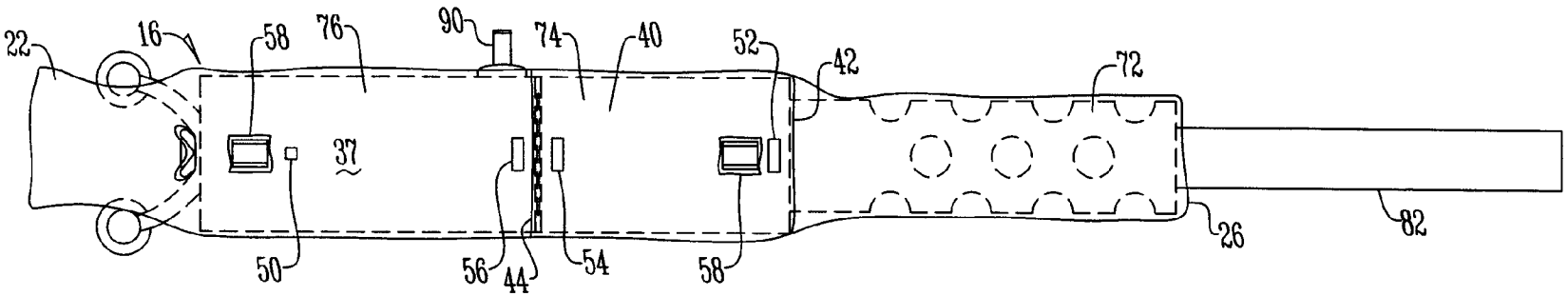
FIG. 3 is a top perspective view of the weapon cover of the present invention mounted on a weapon.
Figure 4:
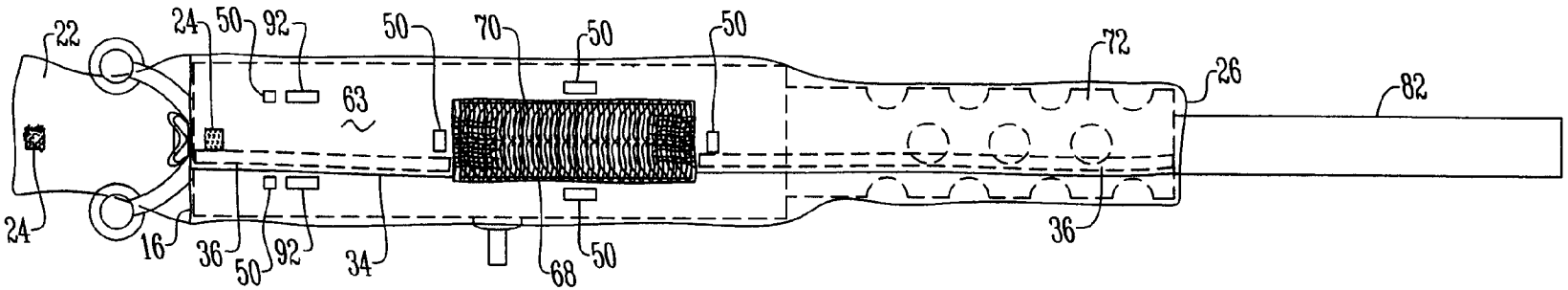
FIG. 4 is a bottom perspective view of the weapon cover of the present invention mounted on a weapon.
Figure 5:
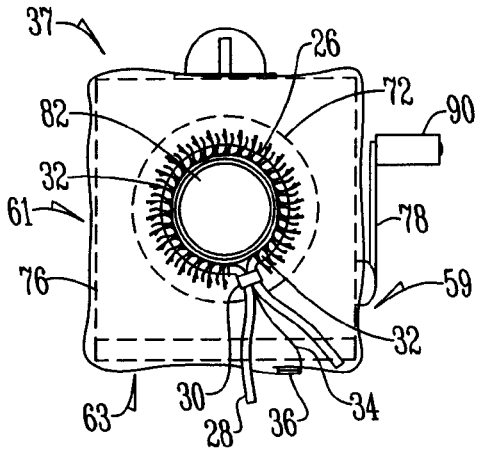
FIG. 5 is a front perspective view of the weapon cover of the present invention mounted on a weapon with the weapon's barrel assembly removed.
Figure 6:
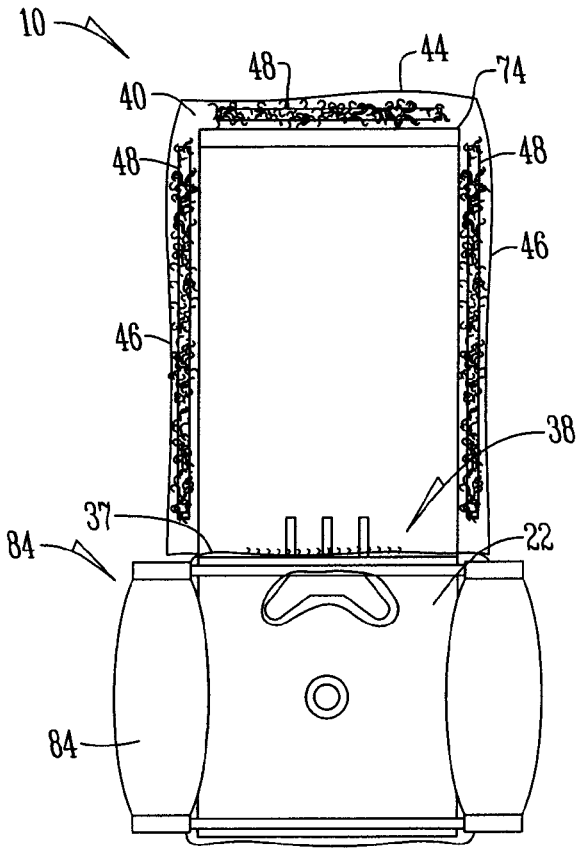
FIG. 6 is a rear perspective view of the weapon cover of the present invention mounted on a weapon with the weapon's cover and feed mechanism assembly open.

The figures present a cover system 10 for a weapon 12. The figures show a cover body 14 being utilized on a weapon 12. The weapon 12 can be any heavy duty weapon including an M2 Browning .50 caliber machine gun, an M249 light machine gun (LMG), an M240-B or M240-S machine gun or the like. Similarly, the cover system 10 can be used to protect any rifle or firearm including civilian and military grade automatic, sub-automatic, belt fed, magazine fed, air cooled, and/or gas operated machine guns, weapons, firearms and the like.

The cover system 10 has a cover body 14 that in a preferred embodiment is made of a heat resistant, breathable, and water proof material. The cover body 14 has a first open end 16. In one embodiment the first open end 16 includes a first pull cord 18 used in combination with a releasable tightener or clasp 20 used to tighten the cover body 14 around the weapon 12. Alternatively, in another embodiment the first open end 16 includes a rear flap 22 which extends over and covers the first open end 16 from a first edge which is affixed to the first open end 16 to a second edge having a fastening attachment 24 which releasably attaches the second edge to the first open end 16 opposite the first edge. In one embodiment the fastening attachment 24 is a hook and loop or Velcro connection, and a complimentary fastening attachment 24 is provided on the cover body 14 adjacent the first open end 16 to engage the fastening attachment 24 of the rear flap 22. The cover body 14 extends from the first open end 16 to a second open end 26 that similarly has a second pull cord 28 and clasp 30. In one embodiment wherein the weapon cover 10 is utilized on retractable barrel weapons such as the M2 Browning .50 caliber machine gun, deflectable bristles 32 surround the second open end 26 to provide a protective barrier ensuring that no moisture, dirt, sand, dust or the like are disposed through the second open end 26 into the weapon 12. Specifically, the bristles 32 protrude from the second open end 26 and surround the outer periphery of the second open end 26 and in a preferred embodiment are made from a semi-rigid nylon material. Furthermore, a longitudinal seam 34 extends along and separates the bottom surface 63 of the cover body 14 from the first open end 16 to the second open end 26. Releasable fastening attachments 36 are provided on adjacent overlapping surfaces of the seam 32 to seal the cover body 14 over a weapon 12 at the seam 32. In one embodiment, the fastening attachments 36 are a hook and loop or Velcro connection.

The cover body 14 also includes a top surface 37, a bottom surface 63, a first side or lateral surface 59 and a second side or lateral surface 61, wherein the cover body 14 between the first and second open ends 16, 26 includes a plurality of openings to accommodate the weapon, and allow the weapon to function normally, be re-loaded, charged, and fired while the cover is on the weapon without requiring removal of the cover. Specifically, the top surface 37 of the cover body 14 includes a top opening 38 that has a sealable flap 40 that is affixed to the top surface 37 of the cover body 14 at a first edge 42. The sealable flap 40 includes a second edge 44 opposite the first edge 42 and lateral edges 46, and attachment members 48 are provided at a second edge 44 and the lateral edges 46 which overlap the top opening 38 so that the flap 40 is secured to the cover body 14 over and covering the top opening 38 in a sealing manner. In one embodiment, the releasable attachment members 48 are provided on adjacent overlapping surfaces of the first edge 42 and lateral edges 46 of the flap 40 and the top opening 38, and the releasable attachment members 48 are a hook and loop or Velcro connection. The sealable flap 40 and top opening 38 also optionally includes magnets 50 embedded therein or attached thereto. In a preferred embodiment, the sealable flap 40 includes a first magnet 52 adjacent its first, fixed edge 42 and a second magnet 54 adjacent the opposite second edge 44 wherein the first and second magnets 52, 54 at the first and second edges 42, 44 secure and maintain the flap's 40 placement upon the weapon. Additionally, a third magnet 56 is provided on the top surface 37 of the cover body 14 adjacent the top opening 38, wherein the third magnet 56 at the top opening 38 likewise secures and maintains the position of top opening 38 upon the weapon upon opening and closing of the sealable flap 40 to permit the sealable flap 40 to be opened to obtain access to the top opening 38 and interior of the weapon 12 and subsequently securely closed and affixed to the cover body 14 to protect the weapon 12. Optionally, the top surface 37 of the cover body 14 includes additional top openings 58 adjacent the first open end 16 and the fixed edge 42 of the sealable flap 40 to accommodate weapon sites and the like protruding therethrough.

The first and second lateral surfaces 59, 61 include a guide rail opening 60, a belt feed opening 62, and an ejection port opening 64 for different portions of the weapon 12. Specifically, the first lateral surface 59 includes a guide rail opening 60 which is a narrow, elongated opening having a size which corresponds with and facilitates the linear reciprocation of a weapon's 12 bolt assembly or cocking/slide handle 78 within the guide rail opening 60. In a preferred embodiment, the elongated guide rail opening 60 includes protective, semi-rigid, deflectable bristles 66 which protrude over, or alternatively, within the elongated guide rail opening 60 to cover and shield the opening and form a protective barrier ensuring that no moisture, dirt, sand, dust, and the like are introduced into the opening while at the same time permitting the slide/cocking handle 78 to reciprocate through the bristles 66 as the weapon 12 is fired. In one embodiment, the bristles 66 are semi-rigid nylon bristles. Furthermore, in a preferred embodiment, one or more lateral surface magnets 50 are provided on the underside or alternatively disposed within the first lateral surface 59 of the cover body 14 adjacent the elongated guide rail opening 60. The one or more magnets 50 attached to the guide rail opening 60 maintain the elongated guide rail opening 60 in a fixed, proper position aligned with the weapon's 12 slide rail.

The first lateral surface 59 also includes an ejection port opening 64 adjacent to the top opening 38 wherein the ejection port opening 64 is sized and positioned to correspond with a weapon's 12 ejection port. The ejection port opening 64 includes deflectable bristles 70 which permit links to be ejected from the weapon's 12 ejection port through the bristles 66 while at the same time covering and protecting the ejection port/inner feed tray assembly 80 and interior of the receiver assembly 76 from dirt, sand, dust, debris, and the like. Additionally, one or more magnets 50 are provided on the underside or alternatively disposed within the first lateral surface 59 of the cover body 14 adjacent the ejection port opening 64 to maintain the position of the ejection port opening 64 aligned with the weapon's ejection port when the cover body 14 is covering and protecting the weapon 12.

The second lateral surface 61 includes a belt feed opening 62 adjacent to the top opening 38 on a surface of the cover body 14 opposite the ejection port opening. In a one embodiment, the belt feed opening 62 is sized and positioned to align with a weapon's 12 opening into which chain or belt linked rounds are fed. Furthermore, in a preferred embodiment, the belt feed opening 62 includes a plurality of protective, semi-rigid, deflectable bristles 66 which protrude over, or alternatively, protrude within the belt feed opening 62 to cover and shield the opening 62 and form a protective barrier ensuring that no moisture, dirt, sand, dust, and the like are introduced into the opening 62 while at the same time deflectably engaging the belt and belt fed rounds as they are fed into the receiver assembly 76, cleaning and removing any moisture, dirt, sand, dust, and the like from the rounds and belt. In one embodiment, the bristles 66 are semi-rigid nylon bristles. Preferably, one or more magnets 50 are provided on the underside or alternatively disposed within the second lateral surface 61 of the cover body 12 adjacent the belt feed opening 62 such that the feed opening 62 maintains a fixed, proper position aligned with the weapon's 12 opening which receives the belt-fed rounds.

The bottom surface 63 of the cover body 14 includes at least a bottom opening 68 having a size and position on the bottom surface of the cover body which corresponds with the opening from which spent casings are ejected from the bottom of the weapon 12. In a preferred embodiment, the bottom opening 68 includes deflectable bristles 70 which protrude from and surround the opening 68 such that the bristles 70 permit the casings to fall through the bottom opening 68 as they are ejected from the weapon. Furthermore, in a preferred embodiment, a plurality of magnets 50 are embedded within or alternatively are attached to the underside of the bottom surface 63 of the cover body 14 adjacent to each side of the bottom opening 68 to maintain the position and alignment of the bottom opening 68 with the weapon's 12 opening from which casings are expelled with the cover body 14 placed over and protecting the weapon 12. Furthermore, in an alternate embodiment, one or more additional mounting openings 92 with magnet 52 surrounding the openings to maintain the position of the openings 92 are provided in the bottom surface 63 of the body 14 to facilitate the weapon's 12 attachment to various mounting devices with the cover body 12 covering and protecting the weapon 12.

In operation, the cover body 14 is placed over the weapon 12, with the second open end 26 placed at the front of the weapon 12 fitting around the front end of the weapon's receiver assembly 76 where the barrel assembly 82 attaches to the weapon's barrel support assembly 72 leaving the barrel 82 exposed and protruding from the second open end 26, thus permitting the barrel 30 to be removed and interchanged when the barrel 30 becomes hot or overheated from prolonged firing. In one embodiment, with the second open end 26 placed at the front of the weapon 12 the cover's bristles 32 protrude from the second open end 26 protecting the interior of the weapon 12 from dust, sand, and the like during removal and replacement of the barrel 82. Alternatively, in embodiments wherein the weapon cover is utilized for weapons such as the M249 light machine gun (LMG) or the M240-B/M240-S machine gun, the second open end 26 is placed at the front of the weapon 12 fitting around the front end of the weapon's receiver assembly 76 where the receiver assembly 76 attaches to the weapon's barrel support assembly 72. Furthermore, the open first end 16 is fitted around the back or rear portion of the weapon's 12 receiver assembly 76.

Simultaneously, the top opening 38 is aligned with the feed tray assembly 80 opening beneath the feed cover 74 via the third magnet 56, and the sealable flap 40 is placed over the surface of the feed mechanism assembly and feed cover 74, with the first and second magnets 52, 54 adhering to the metal surface of the feed cover 74 to maintain the sealable flap 40 adhered to the feed cover 74 in a fixed position and placement as the cover 74 is opened and closed. Thus, the sealable flap 40 is aligned with the feed cover 74 such that the sealable flap 40 pivots at the first edge 42 when the feed cover 74 is opened. In this manner feed cover 74 can easily be opened when loading the weapon 12 and then sealably closed upon completion so that no sand, dirt or dust may enter into the weapon 12. With the feed cover 74 closed, the attachment members 48 maintain the sealing, overlapping connection between the top opening 38 and the sealable flap 40.

Furthermore, when the cover body 14 is on the weapon 12 the guide rail opening 60 is aligned with the slide handle 78 and slide opening of the bolt mechanism of weapon 12 to allow a cocking handle 90 to protrude through the deflectable bristles 66 of the opening 60. Similarly, the belt feed opening 62 and the ejection port opening 64 each align with corresponding openings of the receiver assembly 76, and the bottom opening 68 aligns with the opening in the bottom of the weapon 12 from which casings are ejected. The deflectable bristles 66 covering the belt feed opening 62 engage the belt and belt-fed rounds as they are fed into the receiver assembly 76, cleaning and removing any moisture, dirt, sand, dust, and the like from the rounds and belt. Furthermore, the bristles 70 of the ejection port opening 64 permit links to exit the inner feed tray assembly 80 of the receiver 76 while protecting the interior of the inner receiver assembly and receiver 80, 76 from dust, debris, and the like and deflectable bristles 70 of the bottom opening 68 similarly form a protective barrier ensuring that no moisture, dirt, sand, dust, and the like are introduced into the weapon's bottom opening and correspondingly into the interior of the weapon while permitting spent casings to fall through the bristles 70.

With the cover body 14 placed upon the weapon 12 and the respective cover body 14 and weapon openings aligned, the cover body is sealed around the weapon by joining the complimentary, overlapping fastening attachments 36 along the seam 34 at the bottom surface 63 of the cover body 14. With the cover body 14 secured over the weapon 12 via the seam 34, the second open end 26 is tightened around the weapon 12 via the pull cord 28 and clasp. In embodiments wherein the weapon includes a buttstock assembly 88, such as utilized on the M249 light machine gun (LMG) or the M240-B/M240-S machine gun, the first open end 16 is tightened via the pull cord 18 and clasp 20 around the rear end of the receiver assembly 76 where the receiver assembly 76 attaches to the buttstock assembly 88. Alternatively, in embodiments wherein the weapon includes a back plate assembly 84 with hand grips 86, as utilized in M2 Browning .50 caliber machine gun, the rear flap 22 is extended over the first open end 16 and back plate assembly 84 to secure and cover rear flap 22 in place over first open end 16 and back plate assembly 84 via the fastening attachment 24. Once in place the plurality of magnets 50 magnetically attach to the weapon 12 to keep the cover body 14 in place.

Thus, provided is a multifunctional, heat resistant, and water proof weapon cover system 10 that can be applied quickly and easily to a weapon 12. The system 10 maintains a proper, secure engagement to the weapon while the weapon is reloaded, charged and fired. The system 10 also allows the weapon 12 to function normally and to be reloaded, charged and fired while the cover is on the weapon 12 without requiring removal of the cover body 14. As a result, all of the stated objectives have been met.

It will be appreciated by those skilled in the art that other various modifications could be made to the device without departing from the spirit and scope of this invention. All such modifications and changes fall within the scope of the claims and are intended to be covered thereby.

What is claimed is:

1. A cover system for a weapon comprising a cover body having an open first end that matingly receives a back end of a weapon and an open second end that matingly receives a front end of the weapon such that a barrel of the weapon is exposed;

said cover body having at least two openings disposed therein wherein at least one opening is an elongated rail opening and another opening is a belt feed opening; at least one magnet attached to the cover body to secure the cover body to the weapon; and deflectable bristles protruding over at least an opening to prevent obstructions from entering the opening with said deflectable bristles and damaging the weapon.

* * * * *